United States Patent [19]

Shimada et al.

[11] 4,342,715

[45] Aug. 3, 1982

[54] PROCESS FOR PREPARING WHOLLY AROMATIC POLYAMIDE SHAPED ARTICLES

[75] Inventors: Keizo Shimada; Akihiro Aoki; Hiroshi Mera, all of Iwakuni; Tsutomu Nakamura, Yamaguchi, all of Japan

[73] Assignee: Teijin Limited, Osaka, Japan

[21] Appl. No.: 201,701

[22] Filed: Oct. 29, 1980

[51] Int. Cl.[3] ..... D01F 6/00

[52] U.S. Cl. ..... 264/184; 264/203

[58] Field of Search ..... 264/184, 203

[56] References Cited

U.S. PATENT DOCUMENTS 3,671,542 6/1972 Kwolek ..... 264/184

FOREIGN PATENT DOCUMENTS

| | | | |
|---|---|---|---|
| 38-870 | 2/1963 | Japan | 264/184 |
| 42-815 | 1/1967 | Japan | 264/184 |
| 47-41743 | 10/1972 | Japan | 264/184 |
| 47-50219 | 12/1972 | Japan | 264/184 |
| 48-6417 | 2/1973 | Japan | 264/184 |
| 48-17551 | 5/1973 | Japan | 264/184 |
| 52-77226 | 6/1977 | Japan | 264/184 |

*Primary Examiner*—Jay H. Woo

*Attorney, Agent, or Firm*—Burgess, Ryan and Wayne

[57] ABSTRACT

A wholly aromatic polyamide shaped article is prepared by a process wherein a solution of a wholly aromatic polyamide is extruded through an orifice and introduced into a first coagulating bath comprising an aqueous coagulating liquid and, then, the coagulated extrudate is introduced into a second coagulating bath comprising an aqueous solution of an inorganic salt.

9 Claims, No Drawings

PROCESS FOR PREPARING WHOLLY AROMATIC POLYAMIDE SHAPED ARTICLES

BACKGROUND OF THE INVENTION (1) Field of the Invention

The present invention relates to a process for preparing shaped articles such as fibers, films and tapes, which do not show a substantial loss of clarity and have an excellent gloss, from wholly aromatic polyamides having a good heat resistance.

(2) Description of the Prior Art

It is known that wholly aromatic polyamides synthesized from aromatic diamines and aromatic dicarboxylic acids are excellent in heat resistance and flame resistance. It also is known that these wholly aromatic polyamides are soluble in certain amide solvents, and shaped articles, such as fibers, can be prepared from these wholly aromatic polyamide solutions in amide solvents according to a dry method, a wet method or a dry jet wet method.

However, the dry method is objectionable in that a large quantity of heat is necessary for removal of the amide solvent, which ordinarily has a high boiling point, by evaporation and the equipment investment is therefore large. Furthermore, wet washing is required for removal of the solvent left in the obtained fibers or for removal of the salt added as a solubilizing aid. Therefore, the dry method is disadvantageous from the economical viewpoint as compared with the wet method.

Various coagulating baths have heretofore been proposed in connection with the wet method. For example, Japanese Patent Publication No. 370/63 discloses a process in which a wholly aromatic polyamide is dissolved in an N,N-dialkylamide and shaped articles, such as fibers or films, are prepared by extruding the so formed solution into an aqueous coagulating bath containing calcium thiocyanate. However, loss of clarity cannot be avoided in shaped articles obtained according to this process and desirable shaped articles cannot be prepared according to this process. Furthermore, Japanese Patent Publications No. 41,743/72 and 17,551/73 proposed the use of a coagulating bath consisting of an aqueous solution of calcium chloride. When this coagulating bath is used, a relatively good homogeneous shaped article exhibiting a reduced loss of clarity can be obtained, but the process using this coagulating bath is still not satisfactory in that when the spinning speed is increased, physical properties of the fibers deteriorate, uneven fibers are often formed, and the spinning operation becomes difficult because of yarn breakage. Therefore, it is difficult to raise the productivity.

Japanese Patent Publication No. 815/67 proposes a process in which a shaped article is obtained by subjecting a solution of a wholly aromatic polyamide in an amide solvent to a dry jet wet shaping procedure using an aqueous coagulating bath consisting of water alone or a combination of water with a small amount of a solvent. In this process, however, loss of clarity of the shaped article in the coagulating bath cannot be avoided, and especially in the case of wholly aromatic polyamides having a high content of m-phenylene groups, for example, poly-m-phenylene-isophthalamide, a copolymer composed mainly of poly-m-phenylene-isophthalamide, poly-m-phenylene-terephthalamide and a copolymer composed mainly of poly-m-phenylene-terephthalamide, loss of clarity in the coagulating bath is conspicuous and it is very difficult to obtain good products. As a means for overcoming this defect, Japanese Patent Publication No. 815/67 proposes a method in which the shaped article, withdrawn from the coagulating bath, is treated with an alcohol, such as ethanol or isopropanol, or an aqueous solution of dimethylacetamide, urea or the like. However, the loss of clarity is not completely avoided, and the use of such a treating liquid makes it complicated and difficult to control the solvent vapor at the step of recovering the solvent.

SUMMARY OF THE INVENTION

It is, therefore, a primary object of the present invention to provide a process capable of providing wholly aromatic polyamide shaped articles having excellent physical properties with much reduced loss of clarity advantageously on an industrial scale, while eliminating the foregoing defects of the conventional techniques.

In accordance with the present invention, there is provided a process for preparing a wholly aromatic polyamide shaped article wherein a solution of a wholly aromatic polyamide is extruded through an orifice and the extrudate is introduced into a coagulating liquid to form a shaped article, said process being characterized in that the polymer solution extruded through the orifice is introduced into a first coagulating bath consisting of an aqueous coagulating liquid and, then, the coagulated polymer from the first coagulating bath is introduced in a second coagulating bath consisting of an aqueous solution of an inorganic salt. According to this process, a wholly aromatic polyamide shaped article which does not show a substantial loss of clarity and has an excellent gloss, can be obtained.

By the term "wholly aromatic polyamide" used herein is meant a synthetic linear polymer in which at least 85 mole %, preferably at leat 90 mole %, of recurring units are those represented by the following general formula (I) and/or the following general formula (II):

$$\text{-}(NR_1\text{—}Ar_1\text{—}NR_2CO\text{—}Ar_2\text{—}CO)\text{-} \quad (I)$$

$$\text{-}(NR_3\text{—}Ar\text{—}CO)\text{-} \quad (II)$$

wherein $Ar_1$, $Ar_2$ and $Ar_3$ may be the same or different and stand for a divalent aromatic ring, and $R_1$, $R_2$ and $R_3$ may be the same or different and stand for a lower alkyl group or a hydrogen atom.

As the divalent aromatic ring, there can be mentioned, for example, 1,3-phenylene, 1,4-phenylene, 3,3'-biphenylene, 1,3-naphthylene, 1,6-naphthylene and 2,6-naphthylene groups. Furthermore, the following groups

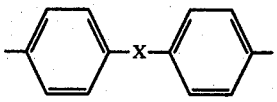

,

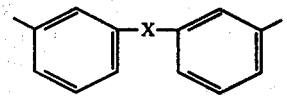

and

-continued

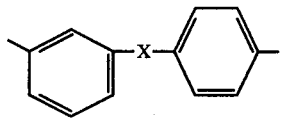

in which X stands for —O—, —$CH_2$—, —$SO_2$—, —S— or —CO— are also included in the scope of the divalent aromatic ring in the present invention. Moreover, some hydrogen atoms on these aromatic rings may be substituted with halogen atoms or other substituents. $R_1$, $R_2$ and $R_3$ stand for a hydrogen atom or an alkyl group having 1 to 3 carbon atoms. As the alkyl group, there can be mentioned, for example, methyl, ethyl and propyl groups.

As the polymer suitable for preparing a shaped aritcle excellent in heat resistance and flame resistance, there can be mentioned, for example, poly-m-phenylene-isophthalamide, copolymers composed mainly of poly-m-phenylene-isophthalamide, such as poly-m-phenylene-isophthalamide/terephthalamide compolymers, poly-m-phenylene/p-phenylene-isophthalamide copolymers and poly-m-phenylene/4-methyl-1,3-phenylene-isophthalamide compolymers, poly-m-phenylene-terephthalamide, copolymers composed mainly of poly-m-phenylene-terephthalamide, poly-p-phenylene-isophthalamide and copolymers composed mainly of poly-p-phenylene-isophthalamide.

The molecular weight of the wholly aromatic polyamide that is used in the present invention corresponds to an inherent viscosity (IV) of 0.8 to 5.5, preferably 1.0 to 3.0, as calculated according to the following formula from the relative viscosity ($\eta r$) measured in concentrated sulfuric acid at 30° C. at a polymer concentration of 0.5 g/100 ml:

$$IV = ln\eta r/0.5$$

As the solvent for the wholly aromatic polyamide, there can be mentioned amide type organic polar solvents, for example, linear N,N-di-lower-alkyl-substituted amides such as N,N-dimethylformamide and N,N-dimethylacetamide; cyclic N-substituted amides such as N-methyl-2-pyrrolidone, N-ethyl-2-pyrrolidone and N-methyl-$\epsilon$-caprolactam; urea type solvents such as N,N,N',N'-tetramethylurea; and N-substituted phosphoramides such as hexamethylphosphortriamide. As the especially preferred solvent, there can be mentioned N,N-dimethylacetamide and N-methyl-2-pyrrolidone.

For the formation of a solution of the wholly aromatic polyamide used in the present invention, there may be adopted a re-dissolving method and a method using a reaction mixture obtained upon termination of the solution polymerization. As the re-dissolving method, there can be mentioned, for example, a method in which a powdery polymer, obtained according to the polymerization process disclosed in Japanese Patent Publication No. 10,863/72, is mixed with a solvent at a desired ratio and dissolved in the solvent. If desired, in the dissolving step, a solubilizing aid, such as a cloride or bromide or calcium, lithium or magnesium, may be added to the polymer solution. As the method using a reaction mixture obtained upon termination of the solution polymerization, there can be mentioned, for example, a method in which a reaction mixture obtained upon termination of the low temperature solution polymerization process disclosed in Japanese Patent Publication No. 14,399/60 is used as it is as a spinning solution. In this case, it is preferable that hydrogen chloride, formed by the polymerization reaction be neutralized with Li(OH), $Li_2CO_3$, $Ca(OH)_2$, CaO, $CaCO_3$ or the like, and the reaction mixture, containing the corresponding metal halide formed by the neutralization, be used as the spinning solution. The amount of the formed metal halide can be varied by neutralizing a part of the hydrogen chloride with a compound capable of reacting therewith, such as ammonia or propylene oxide.

The polymer concentration in the polymer solution may be varied depending upon the particular polymer and the inherent viscosity (IV) of the polymer, but the polymer concentration is ordinarily adjusted to 5 to 30% by weight. In the case of a polymer containing a large proportion of 1,3-phenylene groups in the main chain of the polymer, for example, poly-m-phenylene-isophthalamide or a copolymer composed mainly of poly-m-phenylene-isophthamide, it is preferable that the polymer concentration be adjusted to 18 to 26% by weight.

It is preferable that a metal halide, such as lithium chloride, calcium chloride or lithium bromide, be incorporated in the polymer solution. When such a metal halide is incorporated in the polymer solution, the stability of the polymer solution is enhanced and occurrence of gelation at high temperatures is prevented. Furthermore, loss of clarity in the first coagulating bath consisting of an aqueous coagulating liquid is reduced, and the effects of rendering a uniform and compact texture, achieved by the immersion in the second coagulating bath consisting of an aqueous solution of an inorganic salt, can be enhanced. The amount of such a metal halide incorporated in the polymer solution is not particularly critical, but it is ordinarily preferable that the metal halide be used in an amount of 5 to 50 parts by weight per 100 parts by weight of the polymer.

If desired, additives such as a stabilizer, a delustrant, a coloring agent such as a pigment or dye, and an organic or inorganic filler may be added to the so prepared wholly aromatic polyamide solution.

The wholly aromatic polyamide solution is first subjected to deaeration and filteration, and then, the solution is extruded downward through an orifice directly into the first coagulating bath; or the solution is extruded downward through an orifice held substantially in parallel to the surface of the first coagulating bath, passed through a gaseous atmosphere for a short distance and then introduced into the first coagulating bath. In the latter method, when a spinneret having a plurality of orifices is used, the distance between the face of the spinneret and the surface of the first coagulating bath should be adjusted so that every two adjacent polymer solution streams are prevented from falling into contact with each other. It is ordinarily preferable that this distance be adjusted to 5 to 20 mm.

The temperature adopted for extrusion of the polymer solution may appropriately be selected depending upon the particular polymer, the inherent viscosity and concentration of the polymer, the diameter of the orifice and the extrusion speed. Ordinarily, this temperature is adjusted to 50° to 200° C.

By the aqueous coagulating liquid used as the first coagulating bath in the process of the present invention is meant a coagulating liquid composed mainly of water, and there can be mentioned water and an aqueous solution of an organic compound and/or an inorganic compound. For example, an aqueous solution having the solvent and metal halide extracted from the polymer solution and accumulated therein is preferable from the viewpoint of recovery of the solvent. The solvent concentration in the first coagulating bath can be increased, if the speed of coagulating the polymer solution is not drastically reduced. Although the solvent concentration may be varied, depending upon the particular polymer, the concentration of the polymer and the degree of polymerization of the polymer, it is ordinarily preferable that the solvent concentration be up to 40%, more preferably up to 20%. When the concentration of the metal halide in the first coagulating bath is excessively large, for example, in the case of the production of fibers, the coagulated fibers are softened and the coagulated fibers are caused to rise because of the difference of the specific gravity between the coagulated fibers and the coagulating bath, with the result that the spinning operation becomes difficult. Furthermore, if the spinning speed is increased, fiber unevenness is increased, and in extreme cases, the coagulated fiber cannot resist the tension, and the fiber is broken in the coagulating bath or on contact with a guide hook. Therefore, high speed spinning, which is one of the intended effects of the present invention, becomes impossible. In view of the foregoing, it is preferable that the concentration of the metal halide in the first coagulating bath be controlled to up to 30%, more preferably up to 20%. The solvent concentration and/or the metal halide concentration in the first coagulating bath can be adjusted, for example, by continuously withdrawing a part of the coagulating liquid and supplying fresh water or a water-solvent and/or -metal halide mixture. Other components, for example, polyalkylene glycol, a surface active agent and the like, may be incorporated in the coagulating liquid used as the first coagulating bath so as to adjust the coagulating capability or attain other purposes.

In the process of the present invention, the temperature of the first coagulating bath is important. More specifically, if the temperature of the first coagulating bath is too high, loss of clarity of the shaped article in the first coagulating bath is advanced, and no desired effect can be attained in the succeeding step of dipping in the second coagulating bath consisting of an aqueous solution of an inorganic salt. The product obtained in such case is brittle and lusterless and has a low tensile strength. The suitable temperature of the first coagulating bath, which will not cause such disadvantages, varies depending on the composition of the first coagulating bath or the particular polymer, but this temperature can easily be determined based on experiments. For example, when the first coagulating bath consists substantially of water alone, the bath temperature is preferably in the range of from 0° to 40° C. in the case of a polymer having a high 1,3-phenylene group content, such as poly-m-phenylene-isophthalamide; or the bath temperature is preferably in the range of from 0° to 80° C. in the case of a polymer having a high 1,4-phenylene group content, such as a polymer obtained by copolymerization of terephthaloyl chloride, p-phenylene-diamine and 3,4'-diaminodiphenyl ether.

The time for immersing the extrudate in the first coagulating bath is adjusted, so that during a period spanning from the step of immersing in the first coagulating bath to the subsequent step of immersing in the second coagulating bath, consisting of an aqueous solution of an inorganic salt, or during the immersion treatment in the second coagulating bath, the coagulated shaped article is not drastically deformed; or, if the coagulated shaped article is a filament bundle comprised of a plurality of filaments, undesirable sticking of the filaments to each other is not caused. If the immersion time is extremely long, a non-uniform structure, including micro-voids formed in the coagulated shaped article in the first coagulating bath, cannot be rectified during the immersion treatment in the second coagulating bath, consisting of an aqueous solution of an inorganic salt, and a product having a uniform, fine and compact texture cannot be obtained, even when it is subjected to the immersion treatment in the second coagulating bath, with the result that the intended effects of the present invention cannot be attained. A preferable immersion time varies, depending on the particular polymer, the composition of the polymer solution (for example, the concentration of the polymer and the concentration of the metal halide) and the composition and temperature of the first coagulating bath, and the immersion temperature is appropriately adjusted while the foregoing factors are taken into account.

One of the important characteristic features of the present invention is that the so obtained coagulated shaped article is subsequently subjected to the immersion treatment in the second coagulating bath consisting of an aqueous solution of an inorganic salt. A non-uniform structure having micro-voids formed in the coagulated shaped article in the first coagulating bath is rectified during this step and a uniform, fine and compact texture is restored and a shaped article having an excellent gloss can be obtained. When the resulting shaped article is subjected to washing and drawing operations after the immersion treatment in the second coagulating bath, the properties of the shaped article can further be improved.

The reason why such excellent effects can be attained has not been elucidated completely, but it may be considered that if a salt is dissolved in water at a high concentration, the vapor pressure of water in the aqueous salt solution is reduced and, when the shaped article, which has already been coagulated in the first coagulating bath, is immersed in the second coagulating bath, consisting of such a salt solution, the coagulated shaped article is exposed to a high temperature and excessive water is extracted from the coagulated shaped article, with the result that the effect of making the structure uniform and rendering the texture fine and compact can be attained, because such a coagulated shaped article is treated at a further elevated temperature. It is ordinarily confirmed that when a salt having a higher effect of reducing the water vapor pressure is used or the temperature of the second coagulating bath consisting of an aqueous solution of an inorganic salt is high, the above-mentioned effects of the present invention are prominent. In short, according to the present invention, a coagulated shaped article having a uniform, fine and compact texture can be obtained, although the machnism of this improvement has not completely been elucidated, and by virtue of the effect of improving the drawability, as well as the above-mentioned effect, a wholly aromatic polyamide shaped article excellent in the physical properties can be obtained.

Any of the water-soluble inorganic salts can be used as the inorganic salt to be used for formation of the second coagulating bath. As the inorganic salt that can be advantageously used in the process of the present invention, there can be mentioned calcium chloride, magnesium chloride, zinc chloride, magnesium nitrate, nickel chloride, lithium chloride, sodium chloride, strontium chloride, aluminum chloride, stannic chloride, calcium bromide, calcium nitrate, aluminum nitrate and zinc nitrate. The inorganic salt concentration in the second coagulating bath can be appropriately adjusted, and it is preferable to use an aqueous solution containing at least one member selected from the above-mentioned inorganic salts in an amount of at least 6 gram-equivalents per liter of water (calculated as the anhydrous salt). Especially excellent effects are obtained if the temperature of the second coagulating bath is not lower than 60° C., more preferably not lower than 80° C. As a typical instance of the second coagulating bath, there can be mentioned an aqueous solution of calcium chloride, which preferably contains calcium chloride in an amount of at least 8 gram-equivalents per liter of water and which is maintained at a temperature of at least 60° C., preferably at least 80° C.

The second caogulating bath may comprise at least two baths which may be the same or different in composition.

Immersion of the coagulated shaped article in the second coagulating bath, consisting of the aqueous solution of the inorganic salt, may be accomplished, for example, by winding the coagulated shaped article on a pair of rollers which are partially or completely immersed in the second coagulating bath. In order to enhance the intended effects, it is preferred that the immersion time be more than 1 second, more preferably more than 2 seconds.

A wholly aromatic polyamide shaped article having excellent gloss with a much reduced loss of clarity can be obtained according to the above-mentioned process of the present invention. If this shaped article is subsequently subjected to water washing, hot water drawing and dry heat drawing, a wholly aromatic polyamide shaped article, excellent in the physical properties, heat resistance and flame resistance, can be prepared.

Furthermore, according to the process of the present invention, wholly aromatic polyamide fibers having excellent gloss and physical properties can be obtained at such an elevated spinning speed, as cannot be attained in the conventional wet method or dry jet wet method. Moreover, a large quantity of heat, as required in the conventional dry spinning method for removal of the solvent, is not necessary in the process of the present invention, and equipment investment can be reduced.

The present invention will now be described in detail with reference to the following Examples wherein parts and percents are by weight, unless otherwise specified.

EXAMPLE 1

In 77 parts of N-methyl-2-pyrrolidone were dissolved 23 parts of a wholly aromatic polyamide having an inherent viscosity (IV) of 1.85, which was obtained by polymerization of m-phenylene-diamine and isopthaloyl chloride, and 5.75 parts of calcium chloride. The solution was deaerated and filtered at 80° C. to obtain a spinning dope.

The so formed dope was passed through a transportation system and a spinning head, maintained at 130° C., and the dope was extruded downward at a rate of 19.33 ml/min through a spinneret having 100 holes, each having a diameter of 0.08 mm. The extrudate was passed through air for a distance of about 7 mm and introduced into a first coagulating bath consisting of water containing 5% of N-methyl-2-pyrrolidone and maintained at 18° C. The filament extrudate was passed through a freely rotating hook, located at a depth of 10 cm from the liquid level, and pulled out above the liquid level (the length of the extrudate left immersed was 25 cm). Then, the filament extrudate was wound 20 turns on a second coagulating bath roller member comprising a pair of rollers arranged with a roller gap of 30 cm, the lower portion of which was immersed in a second coagulating bath maintained at 95° C. and consisting of an aqueous solution containing 40% of $CaCl_2$ (12 gram-equivalents per liter of $H_2O$). The peripheral speed of the roller was 58 m/min. It was observed that loss of clarity in the filament extrudate on the second coagulating bath roller member was eliminated with an increase of the number of winding turns and the transparency was increased (the elimination of loss of clarity was completed in the portion of the fifth turn and no substantial change in appearance was observed in the subsequent portion).

The filaments, taken from the second coagulating bath roller member, were then washed in a water-washing bath maintained at 18° C. and another water-washing bath maintained at 50° C., and were drawn at a draw ratio of 2.5 in a hot water bath maintained at 80° C. Subsequently, the drawn filaments were washed in a hot water bath maintained at 90° C., dried on a drying roller having a surface temperature of 120° C., drawn at a draw ratio of 1.38 on a hot plate having a surface temperature of 370° C. and wound at a speed of 200 m/min.

The so obtained filaments exhibited good gloss and had excellent physical properties, such as a fineness of 280 de, a tenacity of 5.0 g/de, an elongation of 21% and an initial modulus of 95 g/de.

COMPARATIVE EXAMPLE 1

Spinning was carried out under the same conditions as adopted in Example 1, except that as the liquid medium in which the second coagulating bath roller member was immersed, water maintained at 18° C. was used instead of the aqueous solution of calcium chloride. The filaments, taken off from the second coagulating bath roller member, were white and loss of clarity was conspicuous. When a section of the filaments was observed through a microscope, it was found that, though large voids were not present, fine voids were present throughout the structure, and the filaments were non-uniform.

Subsequently, the filaments were washed in a water-washing bath maintained at 180° C. and then in a water-washing bath maintained at 50° C., and, when drawing the filaments was tried at a draw ratio of 2.5 in a hot water bath maintained at 80° C., drawing was impossible because of filament breakage. Drawing became possible when the draw ratio was reduced to 2.0. Accordingly, drawing was carried out at this draw ratio, and then, the drawn filaments were washed with hot water, drawn at a draw ratio of 1.3 on a hot plate maintained at 370° C. and wound. Loss of clarity was partially eliminated on the hot plate, but not to the desired extent, and the obtained filaments were whitish and poor in gloss. Furthermore, the mechanical properties of the fibers were not satisfactory, i.e., the fibers had a fineness of 256 de, a tenacity of 2.1 g/de, an elongation of 28% and an initial modulus of 68 g/de.

EXAMPLE 2

A solution having a polymer concentration of 12.1% and comprising 5.6% of calcium chloride, 0.9% of water and 81.4% of N-methyl-2-pyrrolidone was prepared by polymerizing m-phenylene-diamine and terephthaloyl chloride in N-methyl-2-pyrrolidone and neutralizing the reaction mixture with calcium oxide. When the polymer was separated from a part of the solution and the IV value of the polymer was measured, it was found that the IV value was 2.23.

The solution was deaerated and filtered and was extruded downward at a rate of 22.3 ml/min from a spinneret maintained at 130° C., which had 100 holes, each having a diameter of 0.12 mm. The filament extrudate was passed through air along a distance of about 7 mm and introduced into a first coagulating bath consisting of water containing 10% of N-methyl-2-pyrrolidone and maintained at 18° C. The filament extrudate was passed through a freely rotating hook located at a depth of 20 cm from the liquid level and pulled up above the liquid level (the length of the filament extrudate left immersed was 45 cm). Then, the so obtained filaments were wound 20 turns on a second coagulating bath roller rotated at a peripheral speed of 30 m/min, the lower portion of which was immersed in a second coagulating bath maintained at 95° C. and consisting of a 45% aqueous solution of $CaCl_2$ (14.7 gram-equivalents per liter of $H_2O$). Loss of clarity in the filaments on the second coagulating roller was reduced with an increase of the number of winding turns and the transparency was increased.

The filaments taken out from the second coagulating bath roller were washed in water baths maintained at 18° C., 50° C. and 80° C. in sequence, dried on a drying roller having a surface temperature of 120° C. and drawn at a draw ratio of 2.9 on a hot plate having a surface temperature of 400° C.

The obtained filaments exhibited a good gloss, and the filaments had excellent physical properties, such as a fineness of 282 de, a tenacity of 10.1 g/de, an elongation of 13% and an initial modulus of 95 g/de.

EXAMPLES 3 THROUGH 6

Spinning was carried out under the same conditions as adopted in Example 1, except that the composition of the second coagulating bath, in which the second coagulating bath roller member was immersed, was changed as indicated in Table I, below. In each run, it was found that loss of clarity in the filaments was reduced on the second coagulating bath roller member and the transparency was increased.

TABLE I

| Example No. | Inorganic Salt | Concentration (gram-equivalents per liter of $H_2O$) | Properties of Drawn Yarn: Fineness (de) | Tenacity (g/de) | Elongation (%) | Initial Modulus (g/de) |
|---|---|---|---|---|---|---|
| 3 | $MgCl_2$ | 9.0 | 211 | 4.6 | 23 | 90 |
| 4 | $ZnCl_2$ | 16 | 205 | 5.0 | 21 | 100 |
| 5 | $Mg(NO_3)_2$ | 10 | 210 | 4.9 | 23 | 95 |
| 6 | $NiCl_2$ | 12 | 208 | 4.8 | 21 | 90 |

EXAMPLE 7 THROUGH 10

Spinning was carried out in the same manner as described in Example 1, except that the conditions were changed as shown in Table II, below.

TABLE II

| Example No. | Extrusion Conditions: Rate (ml/min) | Temperature (°C.) | Draw Ratios: Hot Water | Dry Heating | Winding Speed (m/min) | Properties of Drawn Yarn: Fineness (de) | Tenacity (g/de) | Elongation (%) | Initial Modulus (g/de) |
|---|---|---|---|---|---|---|---|---|---|
| 7 | 9.65 | 100 | 2.5 | 1.4 | 100 | 198 | 5.6 | 26 | 95 |
| 8 | 14.5 | 120 | 2.5 | 1.4 | 150 | 192 | 5.4 | 20 | 105 |
| 9 | 19.3 | 130 | 2.5 | 1.4 | 200 | 208 | 5.1 | 21 | 95 |
| 10 | 24.1 | 140 | 2.5 | 1.3 | 250 | 211 | 4.8 | 21 | 95 |

In each Example, filaments having a good gloss were obtained without loss of clarity. When the sections of the filaments obtained at a winding speed of 250 m/min were examined through a microscope, it was found that there was no substantial thickness variation along the filament axis and the light-transmittance, that is, the transparency, was very good. Thus, it was confirmed that, according to the process of the present invention, fibers having excellent properties can be obtained even at elevated spinning speeds.

COMPARATIVE EXAMPLES 2 THROUGH 4

In 78 parts of N-Methyl-2-pyrrolidone was incorporated and dissolved 22 parts of the polymer used in Example 1, and the solution was deaerated and filtered at 70° C. to form a spinning dope. Wet spinning was carried out by extruding the so-formed dope into a coagulating bath, consisting of a 43% aqueous solution of calcium chloride and maintained at 95° C., through a spinneret having 100 holes, each having a diameter of 0.07 mm. The filament extrudate was passed through the bath along a distance of about 1 m, and was then washed in water-washing baths maintained at 18° C., 30° C. and 70° C. in sequence. The filament extrudate was drawn in hot water maintained at 90° C., dried on a drying roller having a surface temperature of 120° C. and dry-drawn under heating on a hot plate having a surface temperature of 370° C. The spinning speed, draw ratios and physical properties of the obtained filaments are shown in Table III, below.

TABLE III

| Comparative Example No. | Extrusion Rate (ml/min) | Speed (m/min) of First Roller | Draw Ratio: Hot Water | Dry Heating | Winding Speed (m/min) | Properties of Drawn Yarn: Fineness (de) | Tenacity (g/de) | Elongation (%) | Initial Modulus (g/de) |
|---|---|---|---|---|---|---|---|---|---|
| 2 | 4.8 | 11.3 | 2.83 | 1.56 | 50 | 218 | 5.2 | 23 | 95 |
| 3 | 9.6 | 24.7 | 2.70 | 1.50 | 100 | 208 | 3.8 | 21 | 85 |
| 4 | 14.6 | 46.6 | 2.30 | 1.40 | 150 | 213 | 2.5 | 23 | 70 |

The draw ratio at the drawing in hot water was adjusted to 7/10 of the maximum draw ratio attainable, and the draw ratio at the drawing on the hot plate was adjusted to 8/10 of the maximum draw ratio attainable.

The obtained filaments were excellent in gloss, and loss of clarity was not observed. When the sections of the filaments were examined through a microscope, it was found that when the winding speed was 150 m/min, the drawn filaments were comprised of thin and thick filaments and had a very uneven structure.

EXAMPLE 11

3,4'-Diaminodiphenyl ether, p-phenylene-diamine and terepthaloyl chloride were polymerized at a molar ratio of 25/25/50 in N-methyl-2-pyrrolidone, and the reaction mixture was neutralized with calcium oxide to form a spinning dope having a polymer concentration of 6.0%. The polymer was separated from a part of the dope and the IV value was measured. It was found that the IV value of the polymer was 2.83.

The dope was deaerated and filtered and was extruded downward through a spinneret maintained at 100° C. and having 100 holes, each having a diameter of 0.3 mm. The filament extrudate was passed through air along a distance of about 10 mm and introduced into a first coagulating bath consisting of water containing 15% of N-methyl-2-pyrrolidone and maintained at 50° C. The filament extrudate was passed through a freely rotating hook placed at a depth of 25 cm from the liquid level and pulled up above the liquid level (the length of the filament extrudate left immersed was 70 cm). Then, the filaments, so obtained, were wound on a second coagulating bath roller rotated at a peripheral speed of 20 m/min, the lower portion of which was immersed in a second coagulating bath consisting of a 43% aqueous solution of $CaCl_2$ (13.6 gram-equivalents per liter of $H_2O$) maintained at 95° C. In the filaments wound on the second coagulating roller, it was found that loss of clarity was reduced with an increase of the number of winding turns and the transparency was increased.

The filaments taken out from the second coagulating roller were washed in a multi-staged water-washing bath maintained at 30° to 80° C., dried on a drying roller having a surface temperature of 120° C. and drawn at a draw ratio of 10 on a hot plate having a surface temperature of 490° C.

The obtained filaments exhibited a good gloss and had excellent physical properties characterized by a fineness of 383 de, a tenacity of 29.1 g/de, an elongation of 5.1% and an initial nodulus of 620 g/de.

EXAMPLE 12

The same polymer dope as used in Example 11 was extruded directly in a first coagulating bath consisting of water containing 10% of N-methyl-2-pyrrolidone and maintained at 50° C. at a rate of 35 ml/min through a spinneret having 100 holes, each having a diameter of 0.3 mm. The filament extrudate was passed through the bath along a length of about 50 cm, and was then wound on a second coagulating bath roller rotated at a peripheral speed of 5 m/min, the lower portion of which was immersed in a second coagulating bath consisting of a 43% aqueous solution of $CaCl_2$ (13/6 gram-equivalents per liter of $H_2O$) maintained at 95° C. It was found that loss of clarity in the filament extrudate was eliminated on the second coagulating bath roller and the transparency was increased.

The filaments taken out from the second coagulating bath roller were washed in a multi-staged water-washing bath maintained at 30° to 80° C., dried on a drying roller having a surface temperature of 120° C. and drawn at a draw ratio of 10 on a hot plate having a surface temperature of 490° C.

The obtained filaments exhibited a good gloss and had excellent physical properties characterized by a fineness of 378 de, a tenacity of 26.5 g/de, an elongation of 5.3% and initial modulus of 630 g/de.

EXAMPLE 13

A wholly aromatic polyamide having an inherent viscosity (IV) of 1.95 was prepared by polymerising a 90/10 mixture of m-phenylene-diamine and 4-methyl-1.3-phenylene-diamine with isophthaloyl chloride, and 26 parts of this polymer was mixed at 80° C. with 7.8 parts of calcium chloride and 74 parts of N,N-dimethylacetamide to form a polymer dope. The dope was deaerated and filtered and was then extruded at a rate of 10 ml/min at 140° C. through an orifice having a slit width of 0.1 mm and a slit length of 20 mm. The extrudate was passed through air along a distance of about 15 mm and introduced into a first coagulating bath consisting of water maintained at 5° C. The extrudate was passed through a freely rotating roller placed at a position of 10 cm below the liquid level and pulled up above the liquid level at a speed of 5 m/min. The obtained semi-transparent film was immersed for about 1 minute in a second coagulating bath consisting of a 45% aqueous solution of $CaCl_2$ (14.7 gram-equivalents per liter of $H_2O$) maintained at 95° C. Loss of clarity was eliminated and a transparent film was obtained. The so-obtained film was washed with water and drawn at a draw ratio of 2.0 in the machine direction in hot water maintained at 95° C. Then, the film was drawn at draw ratio of 1.5 in a gaseous medium maintained at 350° C. in the machine direction. Thus, a tough film having a good transparency was obtained.

We claim:

1. A process for preparing a wholly aromatic polyamide shaped article wherein a solution of a wholly aromatic polyamide in an organic polar amide solvent is extruded through an orifice and the extrudate is introduced into a coagulating liquid to form a shaped article; wherein at least 85% by mole of the recurring structural units of said wholly aromatic polyamide is represented by the general formula:

$$-NR_1-Ar_1-NR_2CO-Ar_2-CO- \quad (I)$$

or $$-NR_3-Ar_3-CO- \quad (II)$$

wherein $Ar_1$ $Ar_2$ and $Ar_3$ independently stand for divalent aromatic residues (which includes the divalent residue of the formula:

$$-Ar_4-Y-Ar_5-$$

where $Ar_4$ and $Ar_5$ independently stand for divalent aromatic residues and Y is a divalent radical selected from the group consisting of $$-CH_2-,\ -S-,\ -\underset{\underset{O}{\|}}{C}-,\ -SO_2-\text{and}\ -O-),$$

provided that at least part of the divalent aromatic residues, present in the polyamide, have chain-extending bonds which are metaoriented and neither coaxial nor parallel, and $R_1$, $R_2$ and $R_3$ independently stand for hydrogen or an alkyl group having 1 to 3 carbon atoms;

said process being characterized in that the polymer solution extruded through the orifice is introduced into a first coagulating bath consisting essentially of an aqueous coagulating liquid and, then, the coagulated polymer from the first coagulating bath is introduced into a second coagulating bath consisting essentially of an aqueous solution of an inorganic salt.

2. A process according to claim 1, wherein the polymer solution extruded through the orifice is passed through a gaseous medium and then introduced into the first coagulating bath consisting essentially of an aqueous coagulating liquid.

3. A process according to claim 1 or 2, wherein the second coagulating bath consisting essentially of an aqueous solution of an inorganic salt is a bath containing an aqueous solution of at least one inorganic salt selected from the group consisting of calcium chloride, magnesium chloride, zinc chloride, magnesium nitrate, nickel chloride, lithium chloride, sodium chloride, strontium chloride, aluminum chloride, stannic chloride, calcium bromide, calcium nitrate, aluminum nitrate and zinc nitrate in an amount of at least 6 gram-equivalents per liter of water (calculated as an anhydrous salt).

4. A process according to claim 1 or 2, wherein the second coagulating bath consisting essentially of an aqueous solution of an inorganic salt is an aqueous solution containing calcium chloride in an amount of at least 8 gram-equivalents per liter of water.

5. A process according to claim 1 or 2, wherein the temperature of the second coagulating bath is at least 60° C.

6. A process according to claim 1 or 2, wherein the wholly aromatic polyamide has an inherent viscosity (IV) of 0.8 to 5.5, as calculated according to the following formula from the relative viscosity ($\eta r$) measured in concentrated sulfuric acid at 30° C. at a polymer concentration of 0.5 g/100 ml:

$$IV=(ln\eta r)/0.5.$$

7. A process according to claim 1 or 2, wherein the polymer concentration in the polymer solution is in the range of from 5 to 50% by weight.

8. A process according to claim 1 or 2, wherein the polymer solution contains 5 to 50 parts by weight, based on 100 parts by weight of the polymer, of a metal halide.

9. A process according to claim 1 or 2, wherein the aqueous coagulating liquid in the first coagulating bath contains not more than 40% by weight of the same solvent as used for the preparation of the polymer solution, and not more than 30% by weight of a metal halide.

* * * * *